United States Patent [19]

Metz et al.

[11] 4,421,555

[45] Dec. 20, 1983

[54] METHOD OF AND APPARATUS FOR METALLURGICAL TREATMENT OF A MELT

[75] Inventors: Paul Metz; Edouard Legille; Francois Schleimer; Antoine Weiner, all of Grand-Duchy, Luxembourg

[73] Assignee: Arbed S.A., Luxembourg, Luxembourg

[21] Appl. No.: 360,815

[22] Filed: Mar. 22, 1982

[30] Foreign Application Priority Data

Mar. 23, 1981 [LU] Luxembourg ..... 83247

[51] Int. Cl.[3] ..... C22C 33/08

[52] U.S. Cl. ..... 75/53; 75/129; 75/130 R; 75/130 BB; 266/216

[58] Field of Search ..... 75/53, 59, 129, 130 R, 75/130 BB; 266/216

[56] References Cited

U.S. PATENT DOCUMENTS 3,343,829 9/1967 Coates ..... 75/59

3,484,232 12/1969 Karinthi ..... 75/53

3,619,172 11/1971 Lutgen ..... 75/59

*Primary Examiner*—P. D. Rosenberg

*Attorney, Agent, or Firm*—Karl F. Ross

[57] ABSTRACT

A system for treating, normally refining, a metallurgical melt has a melt-containing vessel having below the level of the melt an at least gas-pervious wall portion. A finely divided treatment solids is suspended in a treatment gas and this suspension is introduced through the pervious wall portion into the melt and reacting the melt with the gas and solids. The wall portion has openings oriented so that the gases and particles can pass into the vessel through them, but the molten metal therein cannot enter them. A plurality of such gas-and particle-pervious inserts are provided in the base of the crucible. They can be individually controlled relative to respective sensors provided above the melt. Thus exothermically reacting gases and/or particles are fed in under cold spots, or endothermically reacting gases and/or particles are fed in under hot spots.

7 Claims, 2 Drawing Figures

METHOD OF AND APPARATUS FOR METALLURGICAL TREATMENT OF A MELT

FIELD OF THE INVENTION

The present invention relates to a method of and apparatus for metallurgically treating a melt. More particularly this invention concerns the purification, alloying, reducing, and otherwise refining of steel.

BACKGROUND OF THE INVENTION

A gaseous or solid additive must be thoroughly contacted with a metal melt in many metallurgical processes. German patent document No. 2,209,902 filed Mar. 1, 1972 by H. Richter et al describes a steel-refining process wherein calcium or calcium compounds such as CaO, $CaF_2$, Ca-Si, $CaC_2$ are blown in an inert vehicle gas into the melt. Calcium at refining temperatures of about 1600° C. has a vapor pressure of 2.13 atm, so that below a depth of 1.7 m this element is a liquid. The lance through which this solids/gas suspension is introduced thus extends down some 2 m below the melt level. The calcium droplets rise slowly and are extremely well contacted with the steel for efficient material use.

The lance has an extremely short service life. The conditions of heat and corrosive chemicals quickly destroy it. In addition, even in procedures other than desulfurizing, this lance is inconvenient and in the way.

It is also known to increase the carbon content of a steel melt, either to improve its quality or to generate heat by subsequent oxidation, by several techniques. Carbon can be introduced by lances in an inert carrier gas and/or a carbon-containing gas can be supplied to crack in the melt and release carbon. Since carbon-containing gases normally also contain hydrogen, which cannot be permitted in steel, this latter procedure is rarely used. It is also possible, as suggested in German patent document No. 2,838,983 filed Sept. 7, 1978 by K. Brotzmann, to treat the melt by means of an oxygen jet played over the melt surface and carrying carbon or appropriate carbon compounds, or even to form such jets by nozzles immediately below the melt surface.

Another procedure uses nozzles provided on the floor of the vessel, and through which the additives are blown. Such nozzles must be made of very valuable material to last at least the life of the oven lining, so that they are very expensive. Furthermore something, if only an inert gas, must be fed in through them all the time to prevent the melt from entering and clogging them, as it is not necessary to continue the additive introduction through the entire life of the melt. Such use of gas can consume important quantities of these gases, which are not necessarily cheap.

Commonly owned Luxembourg Pat. Nos. 82,552, 82,553, 82,554, issued Jan. 20, 1982 and 82,597 issued Feb. 17, 1982 describe a ceramic body forming part of the base of a metallurgical crucible. This sintered ceramic has passages of a small size such that the treatment gas can be introduced while the high surface tension of the melt prevents the melt from flowing back into the openings of the body to block them. Thus this insert remains gas-pervious even if a gas is not forced continuously through it.

OBJECTS OF THE INVENTION

It is therefore an object of the present invention to provide an improved method of and apparatus for treating a metallurgical melt.

Another object is the provision of such a method of and apparatus which overcome the above-given disadvantages.

A further object is to provide such a metallurgical treatment system which allows the solid and gaseous treatment additives to be introduced into the melt right at the floor of the vessel containing it, so as to maximize contact time.

A further object is to provide such an apparatus and method which allow the introduction rates of the solids and gases to be varied independently of each other without using gases unnecessarily.

SUMMARY OF THE INVENTION

These objects are attained according to the instant invention in a system wherein the melt-containing vessel has below the level of the melt an at least gas-pervious wall portion. A finely divided treatment solids is suspended in a gas which may be a treatment gas or simply an inert carrier and this suspension is introduced through the pervious wall portion into the melt to react the melt with the solids. The wall portion has openings oriented so that the gases and particles can pass into the vessel through them, but the molten metal therein cannot enter them.

The instant invention therefore avoids the preconception that it is only possible either to inject solids through a lance, or through expensive nozzles in the base of the crucible. The invention is based on the surprising fact that a good crucible-lining stone can be made which passes both gas and finely divided solids, but not liquid steel.

According to further features of this invention a plurality of such gas- and particle-pervious inserts are provided in the base of the crucible. They can be individually controlled relative to respective sensors provided above the melt. Thus exothermically reacting gases and/or particles are fed in under cold spots, or endothermically reacting gases and/or particles are fed in under hot spots. Normally carbon is blown in mainly at the melt center where it is hottest.

When the vessel has a plurality of such pervious wall portions, the method further comprises the step of detecting the melt temperature at respective locations above the portions and introducing the suspension through the respective inserts in accordance with the detected temperature. It is also possible to vary the reactivity of the gases and/or solids fed in to regulate the melt temperature at the various zones in accordance with this invention.

The apparatus according to this invention therefore has a vessel containing the melt and having below the level of the melt an at least gas-pervious wall portion and means for suspending finely divided treatment solids in a gas and forcing the suspension through the wall portion into the melt, whereby the solids react with the melt. The gas-pervious wall portion is an insert of a porous ceramic. More particularly this insert has a plurality of blocks of the ceramic, metal plates separating the blocks, and an adhesive or mortar securing the blocks to the plates. The suspending means of the instant invention includes a rotary air lock.

When the system of the instant invention is used in an electric-arc furnace for making alloyed steel, the alloying elements are introduced in a distribution or alternately with reacting gases to obtain the desired mixing in the melt. The same procedure applies to deoxidization processes.

In order to desulfurize a melt a crucible with a basic lining is used to contain the melt which is completely covered by an appropriate slag. First pure lime is fed in from the bottom through a powder-porous insert in accordance with this invention. This lime can be carried on an inert gas such as argon so that the melt is covered and cannot pick up oxygen and nitrogen from the air. The input of lime only is stopped and the same feed arrangement introduces a mixture of lime and powdered metallic aluminum to deoxidize the melt. Finally a mixture of lime, calcium floride, and even calcium carbide is introduced through the bottom insert so as to greatly reduce the sulfur content as well as the inclusions.

DESCRIPTION OF THE DRAWING

The above and other features and advantages will become more readily apparent from the following description and example, reference being made to the accompanying drawing in which.

SPECIFIC DESCRIPTION

Figure 1:
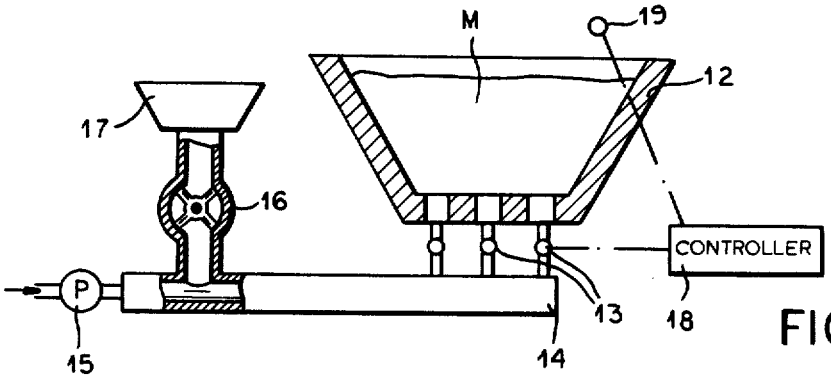
FIG. 1 is a side partly sectional and diagrammatic view of the system of this invention.

As seen in FIG. 1 a crucible 12 filled with a melt M has a floor provided with a plurality of throughgoing inserts 1 each having a feed tube 10 connected to a valve 13 fed in turn off a manifold 14. A pump 15 feeds an inert or treatment gas to the far end of this manifold 14, immediately upstream of a rotary air lock 16 that receives finely divided particulate material from a silo or supply 17. Such a pressure system is described in some detail at page 7–18 of *Chemical Engineers' Handbook* of R. H. Perry and C. H. Chilton (McGraw-Hill: 1973). The valves 13 are all operated by a controller 18 having one or more sensors 19 that can determine the composition and temperature of gases emanating from the top of the melt M.

Figure 2:
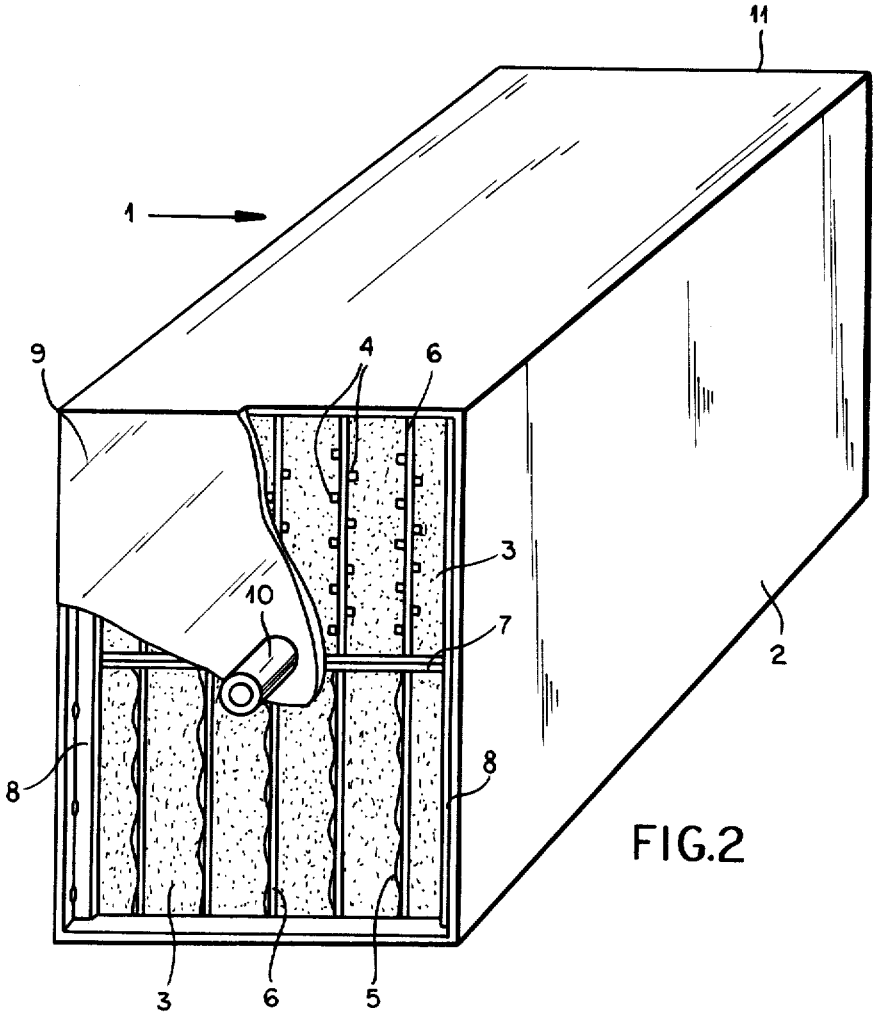
FIG. 2 is a large-scale and partly broken-away perspective view of a pervious insert according to the invention.

FIG. 2 shows the inserts 1, which correspond to the type described in the commonly owned above-cited Luxembourg patents. Each insert 1 has a square-section tubular metal housing 2 containing twelve longitudinally throughgoing ceramic insert blocks or segments 3 of rectangular section and arranged in two rows of six each. Each segment 3 has at least one longitudinally extending side formed with longitudinally throughgoing grooves, or has a wavy side edge 5. Adjacent segments 3 are separated by flat metal plates 5, with pairs of such plates 7 provided between the two rows. An appropriate mortar secures the segments to the plates 6 and 7, completely filling the spaces therebetween to prevent gas flow along the interface between the segments 3 and plates 6 and 7. Spacers 8 keep the ends of the segments spaced slightly from an end wall 9 through which the feed pipe 10 feeds a suspension of gas and particles to the insert 1, so that gas and finely divided particles can pass longitudinally through the throughgoing grooves of segments 3 and exit from the opposite ends 11 thereof.

The segments or blocks 3 are of sintered ceramic construction and may have the following composition by weight:

MgO: 96.2%
$Fe_2O_3$: 0.2%
$Al_2O_3$: 0.1%
CaO: 2.5%
$SiO_2$: 1.0% and the following particle distribution, by weight:

5 mm–8 mm: 20%
3 mm–5 mm: 15%
1 mm–3 mm: 20%
0 mm–1 mm: 20%
0 mm–0.1 mm: 25%.

An amount equal to 4% by weight of anthracite-coal pitch can be added as binder.

More details on the construction and composition of the inserts 1 can be had from the above-cited Luxembourg patents.

EXAMPLE

A method of the general type described in commonly owned Luxembourg Pat. No. 81,207 is employed. Such a method works on the LD or LDAC principle, reducing a mixture of 38%–40% scrap per ton of pig iron—as compared to 25%–27% by earlier processes—by blowing it with oxygen while increasing the heat of the process by afterburning the carbon monoxide generated by the process directly above the melt. Since the carburizing of pig iron is basically an endothermic reaction, introducing large quantities of inert gas with the carbon greatly slows it. Thus in order to obtain a 3% by weight carbon concentration in a large 200-ton crucible it is normally necessary to waste a great deal of carbon and inert gases. Reference should be made to Luxembourg Pat. No. 81,207 for further details.

The procedure of the instant invention refines a 3%- to 4%-carbon pig-iron melt by blowing with oxygen to reduce the carbon concentration to about 2%. Adding scrap and afterburning the CO generated over the melt can produce enough heat to take the process this far. Then particulate carbon is introduced through the gas- and particle-pervious wall portion 1 according to this invention, carried on an inert gas. Such introduction of carbon is kept up until the desired carbon concentration is obtained, whereupon more scrap can be added.

The carbon used has a particle size between 80 microns and 200 microns (1.0 micron$=10^{-6}$ meter), which is quite small compared to the average particle size of the segments 3. The inert gas is argon or nitrogen and is fed in at a rate between 20 m/sec and 30 m/sec. Thus about 12 kg of gas is carried by each $Nm^3$ of gas per minute into the vessel.

We claim:

1. A method of treating a metal melt comprising the steps of:

containing said melt in a vessel having below the level of said melt a gas-pervious wall portion defined by ceramic blocks defining narrow channels preventing the passage of molten metal therethrough;

suspending finely divided treatment solids in a gas; and introducing the suspension through said wall portion into said melt and reacting said melt with said solids.

2. The method defined in claim 1 wherein said vessel has a plurality of such pervious wall portions, said method further comprising the step of detecting the melt temperature at respective locations above said portions and introducing said suspension through the respective inserts in accordance with the detected temperature.

3. The method defined in claim 2 wherein said melt is ferrous.

4. An apparatus for treating a metal melt, said apparatus comprising:

a vessel containing said melt and having below the level of said melt an at least gas-pervious wall portion; and means for suspending finely divided treatment solids in a gas and forcing the suspension through said wall portion into said melt, whereby said solids react with said melt.

5. The apparatus defined in claim 4 wherein said portion is an insert of a porous ceramic.

6. The apparatus defined in claim 5 wherein said insert has:

a plurality of blocks of said ceramic;

metal plates separating said blocks; and an adhesive securing said blocks to said plates.

7. The apparatus defined in claim 4 wherein said means for suspending includes a rotary air lock.

* * * * *